United States Patent [19]

Hall

[11] 4,195,416

[45] Apr. 1, 1980

[54] COMBINATION HAIR/HAND/BODY DRYER AND VAPOR DISPENSER

[76] Inventor: Marshall J. Hall, P.O. Box 67, Mona Vale, N.S.W., Australia, 2103

[21] Appl. No.: 909,527

[22] Filed: May 25, 1978

[30] Foreign Application Priority Data

| | | | |
|---|---|---|---|
| May 30, 1977 | [AU] | Australia | PD0274 |
| Aug. 3, 1977 | [AU] | Australia | PD1092 |
| Mar. 23, 1978 | [AU] | Australia | 34492/78 |

[51] Int. Cl.[2] ..... F26B 19/00

[52] U.S. Cl. ..... 34/90; 34/97; 34/233

[58] Field of Search ..... 34/3, 53, 90, 91, 96, 34/97, 98, 233, 243; 219/366, 367, 368, 369, 370, 371, 374

[56] References Cited

U.S. PATENT DOCUMENTS

| | | | |
|---|---|---|---|
| Re. 18,240 | 11/1931 | Brown | 34/90 |
| 1,678,554 | 7/1928 | Burgess | 34/90 X |
| 2,504,740 | 4/1950 | Siegel | 34/90 X |
| 2,698,894 | 1/1955 | Stein | 34/53 X |

FOREIGN PATENT DOCUMENTS

| | | | |
|---|---|---|---|
| 292597 | 11/1953 | Switzerland | 34/3 |

*Primary Examiner*—Edward G. Favors
*Attorney, Agent, or Firm*—Gifford, Chandler, VanOphem, Sheridan & Sprinkle

[57] ABSTRACT

A cabinet adapted to be mounted on a wall of a washroom or similar facility is provided with a conventional hand-held hair dryer secured within the cabinet and positioned so that the output of the hair dryer is projected through a vent opening in the cabinet. The hair dryer is controlled by a push-button time switch and the push button of the switch is operable from the outside of the cabinet. A suitable vaporizing substance is disposed within the cabinet adjacent to the inlet of the hair dryer so that the fumes are expelled through the vent together with the heated air. Additional electrical circuitry can be provided to override the time switch and to provide power outlets for washroom accessories such as electric shavers or lighting.

10 Claims, 2 Drawing Figures

COMBINATION HAIR/HAND/BODY DRYER AND VAPOR DISPENSER

BACKGROUND OF THE INVENTION

I. Field of the Invention

The invention relates generally to time controlled electric hand-held blower dryers and more particularly to such devices detachably secured within a cabinet adapted to hold a vapor source and permit the vapor to be expelled into the surrounding atmosphere.

II. Description of the Prior Art

Wall mounted blower dryers are well known in the prior art. It is advantageous to provide such a device in public washrooms, hotel rooms and the like. However, the previously known devices have relatively expensive heating means, are not capable of being used simultaneously as vapor dispensers for air freshener or the like, and do not provide additional storage facilities or power outlets for electrical accessories.

SUMMARY OF THE INVENTION

The present invention obviates the above-mentioned vapor dispenser and comprises further development on the inventions described in Australian provisional patent applications Nos. PD 0274/77 and PD 1092/77.

Application No. PD 1092/77 describes an electric hair dryer modified so as to be usable also as a time controlled hand dryer set to switch off automatically after a predetermined period.

Application No. PD 0274/77 describes an electric hair dryer incorporated in a cabinet so that when the dryer is turned on, not only can it act as a hand or body dryer, but simultaneously it can act also to disseminate vapors of volatile material such as fumigant, deodorizer, insecticide, room freshener and the like, through the cabinet and out into the surrounding atmosphere.

The present invention comprises in combination a cabinet, which is conveniently mountable on a wall in a domestic or commercial bathroom, washroom or the like, such as for example, in a motel suite; an electric hair dryer of the hand holdable type, releasably secured in the cabinet and connected or connectable through switch means to an electric power source, the hot air outlet of the dryer being so shaped and disposed in the cabinet as to project through a vent hole provided in the cabinet wall; a replenishable source of volatile material such as deodorant, fumigant, insecticide, room freshener or the like, provided in the cabinet, preferably directly adjacent the air intake of the hair dryer; and a push-button time switch operable from outside the cabinet and wired electrically in parallel with the electrical lead to the hair dryer, the arrangement being such that the hair dryer is actuated by the push button or is independently actuated by a manually operable on/off toggle switch across the power source.

Preferably the cabinet has a slidable mirror-faced panel which slides horizontally across the cabinet and beyond on either side thereof to uncover either the aforesaid hair dryer and volatile material housed on one side of the cabinet or conventional shelving or the like, preferably removable, housed in the other side of the cabinet.

The cabinet may be mounted on a wall or other suitable place with the air vent hole facing outward or down towards the floor and may incorporate an internally mounted single or double electric power socket connected to a common electrical outlet or other suitable power source, into which socket a plug wired to the hair dryer may be inserted. A further electric appliance, such as an electric shaver, may conveniently be used with the other socket if a double plug is present, and may, as well as the hair dryer, conveniently be stored away in the cabinet when not in use.

Alternatively, instead of the hair dryer being pluggable into one of the sockets, it may have a long electric cable connected directly to the common electrical outlet through, for example, the push-button switch assembly and if desired, a coin-feed apparatus may be incorporated in the circuit so that in a commercial situation, patrons may only have extended use of the hair dryer through the coin-feed apparatus.

Preferably the push-button time switch is mounted in the cabinet sidewall on that side where the dryer is housed and the push-button is conveniently located outside the cabinet for easy operation by a user. The reset of the time switch assembly is preferably mounted inside the cabinet and is electrically connected in parallel with a manual switch in the electrical lead to the hair dryer so that when the push-button is pressed, the dryer is switched on and, after a predetermined time, automatically is swtiched off although still allowing independent on/off actuation of the dryer directly from the power source. The hot air from the dryer comes out through the vent hole of the cabinet, and simultaneously, the vapor from the volatile material is drawn into and through the air channel of the dryer and is discharged through the dryer nozzle and consequently through the vent hole in the cabinet to the surrounding atmosphere.

Preferably, the volatile material is housed in a container having one or more escape holes, the smaller the better, and supported on a ventilated shelf within the cabinet, preferably close to the air intake of the dryer. If on a shelf or the like, such a shelf is conveniently provided with a plurality of holes or vents so that vapor from the volatile material may be sucked therethrough into the air inlet of the hair dryer. It will be found that a concentration of vapor builds up in the compartment formed in the cabinet above the ventilated shelf so that as soon as the dryer is turned on, this accumulated volatile material or gas immediately is dispensed into the room. In the case of air freshener for example, this happens simultaneously with the drying of a user's hands at the very time when such room freshening is desired.

Any conventional hair dryer may be used in this invention, and may be releasably mounted, preferably by means of spring clips or lugs, inside the cabinet. Most conventional hand-held hair dryers already have a tapered air outlet nozzle, but if such a nozzle is not provided, then a suitable shaped nozzle may be attached to the air outlet of the dryer so that it aligns with the vent hole of the cabinet.

For convenience, an electric light is placed on the cabinet so that it would illuminate a user and would be switched on independently or in conjunction with the dryer so that when the dryer is used the light would also come on. Alternatively, the light would be operable independently of the dryer circuit so that if another appliance, such as an electric shaver, were to be used, a user could also switch the light on or off.

Switching for the power socket could be mounted in the cabinet with switches operable from outside the cabinet if desired. The use of each switch could be marked thereon. Alternatively, a socket for the plug (or plugs) could be built into the cabinet body and be useable from outside the cabinet.

It will readily be appreciated that the combination hair/hand dryer and vapor dispenser of the present invention is very versatile and allows a relatively inexpensive item of equipment, the electric hand-held dryer, to be used either as a hair or a hand or body dryer, and at the same time utilizes the suction of the hair dryer to draw vapor from desirable volatile materials through the dryer and out the cabinet vent hole or holes, and to dispense these into the air of wash rooms, W.C's, shower and change rooms and other like places.

A further advantage of the combination of the present invention is that the cabinet feature allows the dryer (and other appliances such as an electric shaver) to be stored out of sight yet already plugged in for instant use if required, instead of having to remove the dryer from a box, finding a handy power outlet into which it may be plugged, and then removing the dryer after use and repacking it into a box or other cupboard where it normally is stored.

It is envisaged that in domestic or motel use, the cabinet may readily be openable by a householder or guest so that the hair dryer may be used for its primary hair drying purpose if so desired. If experience shows that motel guests tend to steal the dryers, then these can be fixedly wired to main power outlets or, optionally, through some coin-feed mechanism, so that the guests only have the use of the dryer within the time switch time by inserting a coin into the coin-switch apparatus.

The dryer may be removed from the cabinet and used in front of the mirror on the slidable front panel of the cabinet, or, if provided with its own cable and plug, may be unplugged from the cabinet socket and taken elsewhere for use.

If on the other hand the cabinet unit is intended for use in a public washroom, the invention may be provided as a "sealed unit", that can not be opened by a member of the public. In this case, the main use of the dryer is as a hand dryer and simultaneous vapor dispenser, since there is no need for the dryer to have its own detachable plug and cable. Instead, the dryer is fixedly wired directly to the main power wiring, preferably through the push-button time switch with a single pole, single throw switch in the electrical lead from the push-button time switch to the dryer. The invention also embraces a sealed unit such as that above described, wherein the heating means and vaporizing and dispensing means is not a hair dryer but is a heating and suction means so located in the cabinet as to simultaneously dispense desired gases from volatile materials when discharging hot air therefrom into a room.

When a hair dryer is the heating and freshening means, the temperature of the hot air emitted through the cabinet vent hole may be controlled by selecting one of the settings customarily provided on hair dryers.

The push-button time switch circuit can also incorporate a two pole single or double throw switch to operate an electric light located on the outside of the cabinet so that the light may come on simultaneously with the pressing of the button of the push-button time switch and of course with the dryer for a predetermined time, or, the light may be operated in conjunction with the dryer when used for a longer indefinite period as a hair dryer, or, the light may be used independently of the time switch and hair dryer.

BRIEF DESCRIPTION OF THE DRAWINGS

The invention will now be further described, by way of example, by reference to the accompanying drawings wherein like reference characters refer to like parts in each of the views and wherein.

DETAILED DESCRIPTION OF THE INVENTION

Figure 1:
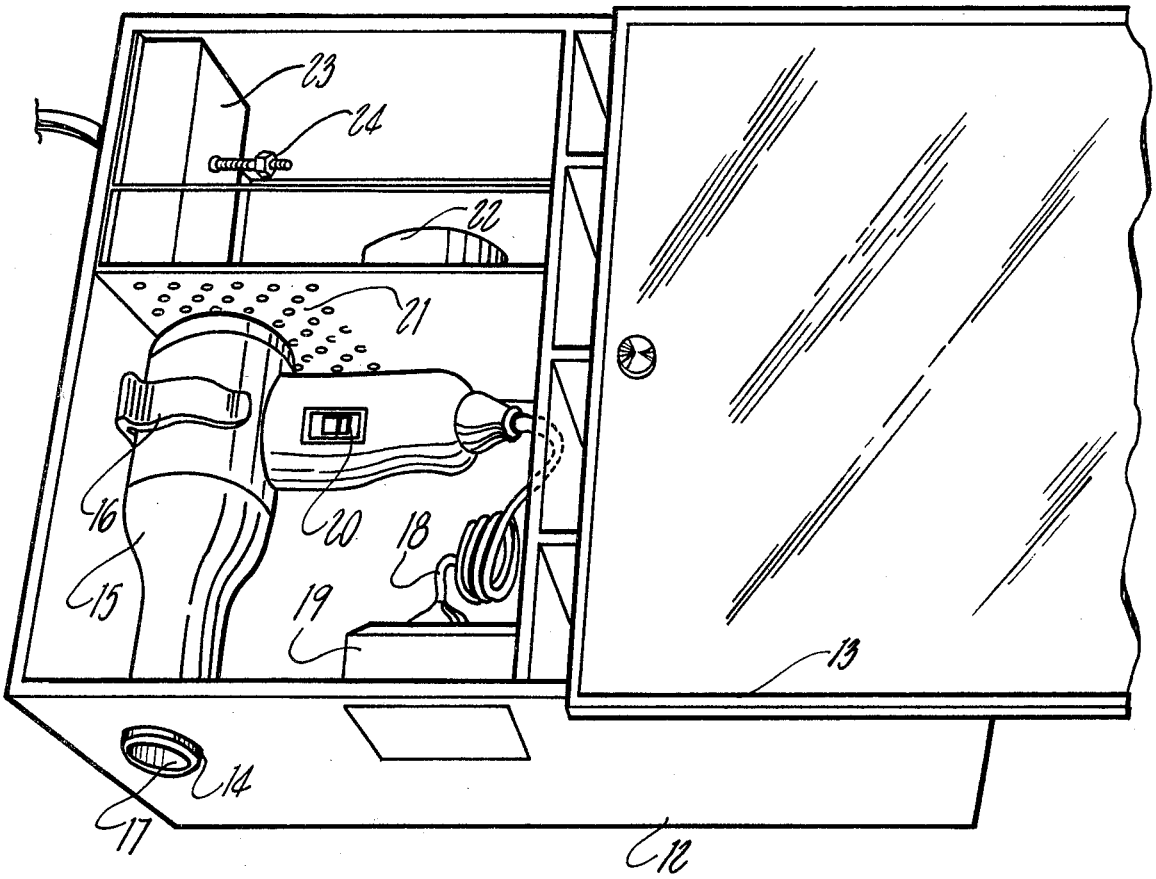
FIG. 1 is a perspective view of a partly open combination cabinet; hair dryer and vapor dispenser according to the invention.

Referring now to the combination shown in FIG. 1, a cabinet 12 is shown with a portion of a mirrored slidable face panel 13 half open. It will be realized that the mirror can be of any desired shape, for example circular, and does not affect the essential elements of the combination of the present invention.

The bottom wall of the cabinet 12 has a vent 14 and a hand-holdable hair dryer 15 is releasably positioned in the cabinet 12 by means of a spring clip 16 so that the nozzle 17 of the hair dryer 15 just projects through the vent 14. An electric cable 18 of the hair dryer 15 plugs into a power socket 19 which is connected to a main power source (connection not shown). An on/off toggle switch 20 is provided on the hair dryer 15. A ventilated shelf 21 is provided above the hair dryer 15, the air inlet of the hair dryer being positioned below the vents and a block of volatile air freshener 22 is supported on the shelf 12. An alternative support in the form of a threaded bolt and nut 24 is provided so that in the event that no shelf 21 is provided, the air freshener can be provided in a can or in the form of a block or the like, which can be hung from the support 24.

Figure 2:
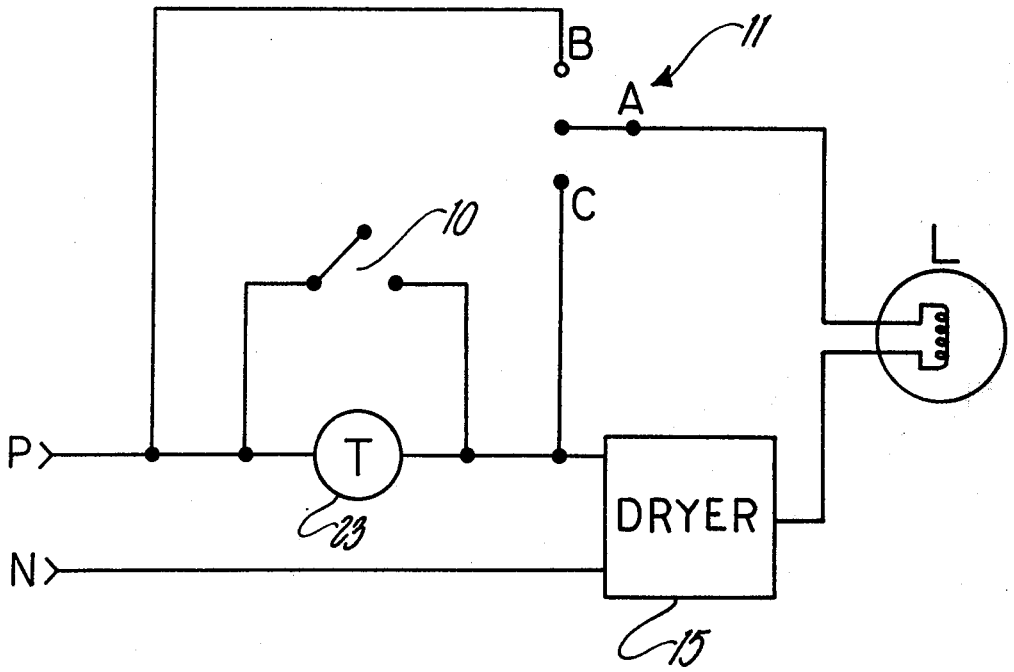
FIG. 2 is a diagrammatic circuit layout of the wiring of the combination of the invention.

A time switch 23, wired as shown diagrammatically in FIG. 2, is provided in the cabinet 12 and a hand operable push-button (not shown) is provided on the outside of the cabinet for convenient use.

Referring now to the circuit diagram shown in FIG. 2, time switch 23 is shown in the power lead P to the dryer. A single pole, single throw switch 10 is provided in parallel with the time switch 23 so that the push-button of the time switch may operate the dryer simultaneously with the time switch when the switch 10 is opened. When the switch 10 is closed, the dryer may be operated independently of the time switch.

A single pole, double throw switch 11 is provided in the power lead to an electric light L (not shown in FIG. 1). When the switch contacts 11A and 11C are closed or connected together by the switch 11, the light comes on automatically when the dryer is actuated by either the time switch or the SPST switch 10. Conversely, when the switch 11 connects or closes the contacts 11A and 11B, the light is directly connected to the power line P and the light is operable independently from the circuit shown, that is independently of either the time switch or the dryer.

I claim:

1. A hair/hand/body dryer and simultaneous vapor dispenser housed in a cabinet mountable in or on a building, for example in a bathroom, washroom shower and change room or other like area, comprising in combination:

a cabinet having a vent, a suction and heating means mountable in the cabinet and having a cold air intake and a hot air outlet, the hot air outlet of the suction and heating means being so shaped and disposed in the cabinet so as to project expelled air through said vent provided in the cabinet wall;

a supply of vaporizing material;

means for supporting and replenishing the supply of said vaporizing material;

and means for electrically connecting said suction and heating means to an electric power source, said electrical connection means comprising a power lead, a push-button time switch wired electrically in series with the power lead to the suction and heating and a manually operable on/off switch wired electrically in parallel with said push-button time switch so that said suction and heating means is actuated by the push-button or independently by the manually operable on/off switch across the power source.

2. A hair/hand/body dryer and vapor dispenser as claimed in claim 1 wherein the vaporizing material is located directly adjacent the air intake of the combination suction and heating means.

3. A hair/hand/body dryer and simultaneous vapor dispenser as claimed in claim 1 wherein the means for supporting and replenishing the supply of vaporizing material comprises a ventilated shelf located in the cabinet above the air intake of the combination suction and heating means.

4. A hair/hand/body dryer and vapor dispenser as claimed in claim 1, wherein the cabinet is provided with a vertical divider on one side of which are housed the suction and heating means and the vaporizing material, and conventional bathroom cabinet shelves and the like are provided in the other half of the cabinet.

5. A hair/hand/body dryer and simultaneous vapor dispenser as claimed in claim 1, wherein at least one socket power outlet is provided in the cabinet for operation of the combination suction and heating means.

6. A hair/hand/body dryer and vapor dispenser as claimed in claim 1 wherein an electric light is mounted on the outside of the cabinet and is connected in circuit with the time switch and the combination suction and heater means by a two pole single or double throw switch, so that the light may be operated by the push button of the time switch simultaneously with the timed operation of the combination suction and heating means; and so that the light can be operated with the combination suction and heating means for any time the latter is operative; and so that the light may be independently operable.

7. A hair/hand/body dryer and vapor dispenser as claimed in claim 1 wherein the cabinet is provided with a two-way horizontally slidable mirrored face panel.

8. A hair/hand/body dryer and vapor dispenser as claimed in claim 1 wherein the cabinet includes selectively operable locking means for lockingly enclosing said suction and heating means and the vaporizing material within the cabinet.

9. A hair/hand/body dryer and vapor dispenser as claimed in claim 1 wherein the combination suction and heating means is an electric hair dryer of the hand holdable type.

10. A hair/hand/body dryer and vapor dispenser as claimed in claim 9 wherein the hair dryer is releasably mounted in the cabinet.

* * * * *